US008795151B2

(12) United States Patent
Falk et al.

(10) Patent No.: US 8,795,151 B2
(45) Date of Patent: Aug. 5, 2014

(54) INFANT CARE SYSTEM AND APPARATUS

(75) Inventors: Steven Mitchell Falk, Laurel, MD (US); David M. Mills, Niskayuna, NY (US); Lawrence G. Ten Eyck, Laurel, MD (US); Marjorie McCue, New Market, MD (US)

(73) Assignee: General Electric Company, Schenectady, NY (US)

( * ) Notice: Subject to any disclaimer, the term of this patent is extended or adjusted under 35 U.S.C. 154(b) by 630 days.

(21) Appl. No.: 12/941,667

(22) Filed: Nov. 8, 2010

(65) Prior Publication Data

US 2012/0116150 A1 May 10, 2012

(51) Int. Cl.
*A61G 11/00* (2006.01)

(52) U.S. Cl.
CPC ..... *A61G 11/00* (2013.01); *Y10S 128/92* (2013.01); *Y10S 435/809* (2013.01)
USPC ..... 600/22; 600/301; 128/920; 119/304; 119/315; 119/311; 236/2; 237/14; 237/3; 435/303.1; 435/809

(58) Field of Classification Search
USPC ..... 119/304, 315, 311; 236/2, 91; 200/61; D24/163; 600/22, 301; 237/3, 14; 435/303.1, 809; 128/920
See application file for complete search history.

(56) References Cited

U.S. PATENT DOCUMENTS

| | | | | |
|---|---|---|---|---|
| 4,936,824 | A | 6/1990 | Koch et al. | |
| 5,474,517 | A | 12/1995 | Falk et al. | |
| 6,213,935 | B1 | 4/2001 | Mackin et al. | |
| 6,409,665 | B1 * | 6/2002 | Scott et al. | 600/437 |
| 7,282,022 | B2 | 10/2007 | Falk et al. | |
| 2002/0082468 | A1 * | 6/2002 | Goldberg et al. | 600/22 |
| 2002/0103432 | A1 * | 8/2002 | Kawchuk | 600/437 |
| 2003/0153805 | A1 * | 8/2003 | Gryn et al. | 600/22 |
| 2005/0124866 | A1 * | 6/2005 | Elaz et al. | 600/301 |
| 2005/0133027 | A1 * | 6/2005 | Elaz et al. | 128/200.24 |
| 2005/0143632 | A1 * | 6/2005 | Elaz et al. | 600/301 |
| 2005/0215844 | A1 * | 9/2005 | Ten Eyck et al. | 600/22 |
| 2007/0149843 | A1 * | 6/2007 | Ten Eyck et al. | 600/22 |
| 2008/0183029 | A1 * | 7/2008 | Mackin et al. | 600/22 |
| 2009/0043204 | A1 * | 2/2009 | Pelissier et al. | 600/446 |

* cited by examiner

*Primary Examiner* — Christine Matthews
*Assistant Examiner* — Sunita Reddy
(74) *Attorney, Agent, or Firm* — Andrus Intellectual Property Law, LLP

(57) ABSTRACT

An infant care system and apparatus includes a horizontal surface to support an infant. A microenvironment region is defined around the horizontal surface by at least one wall. A graphical display is disposed within the microenvironment region. A diagnostic imaging device is at least partially disposed within the microenvironment region to obtain diagnostic images of an infant disposed within the microenvironment region.

20 Claims, 4 Drawing Sheets

INFANT CARE SYSTEM AND APPARATUS

BACKGROUND

The present disclosure is related to the field of infant care. More specifically, the present disclosure is related to systems and apparatus for providing a microenvironment for an infant.

Prematurely born infants require specialized treatment and care due to their small size and still-developing organs and physiological systems. Thus, premature infants are placed in devices that create a carefully controlled microenvironment around the patient.

One type of device is generally referred to as an incubator in which the patient is placed within a physical enclosure and the temperature within the enclosure is carefully controlled with convective heating provided by a forced flow of heated air into the enclosure.

Another device is called a radiant warmer. The radiant warmer has an overhead canopy with calrod heating elements that produce radiant heat that is directed downward onto the patient.

Hybrid systems that incorporate both convective heating systems and radiant heating systems are also provided.

While the microenvironment includes temperature regulation, some microenvironments may also encompass more than thermal regulation. These microenvironments may include an oxygen enriched environment or humidity control.

BRIEF DISCLOSURE

An infant care apparatus includes a horizontal surface configured to support an infant. A microenvironment region is defined by at least one wall extending generally vertically from the horizontal surface. A graphical display is disposed within the microenvironment region. A diagnostic imaging device is at least partially disposed within the microenvironment region. A processor is coupled to the display and the diagnostic imaging device.

An alternative embodiment of an infant care apparatus includes an infant care platform comprising a surface configured to support an infant. At least one wall extends generally upwards from the infant platform. The infant platform and the at least one wall define a three-dimensional microenvironment region. A heat source is configured to warm the microenvironment region to a predetermined temperature. A first graphical display is disposed within the microenvironment region. A diagnostic imaging device is at least partially disposed within the microenvironment region. The diagnostic imaging device extends into the microenvironment region through a first port in the surface of the infant platform. A processor is coupled to the display and the diagnostic imaging device. The processor operates the diagnostic imaging device to acquire diagnostic images and the processor operates the graphical display to present the diagnostic images on the graphical display.

An infant care system includes an infant platform with a surface configured to support an infant. At least one wall extends generally upwards from the surface. The surface and the at least one wall define a microenvironment region. A diagnostic imaging device is at least partially disposed within the microenvironment region. The diagnostic imaging device is configured to obtain diagnostic images of the infant in the microenvironment region. At least one physiological transducer is at least partially disposed within the microenvironment region. The physiological transducer is configured to obtain physiological data from the infant in the microenvironment region. A first graphical display is disposed within the microenvironment region to present the diagnostic images of the infant. A second graphical display is disposed outside of the microenvironment region to present the physiological data. A processor is communicatively connected to the diagnostic imaging device, the at least one physiological transducer, the first graphical display, and the second graphical display. The processor is able to control the diagnostic imaging device to acquire diagnostic images and to control the first graphical display to present the acquired diagnostic images. The processor is further operable to acquire physiological data through the at least one physiological transducer and to control the second graphical display to present the physiological data.

DETAILED DISCLOSURE

Figure 1:
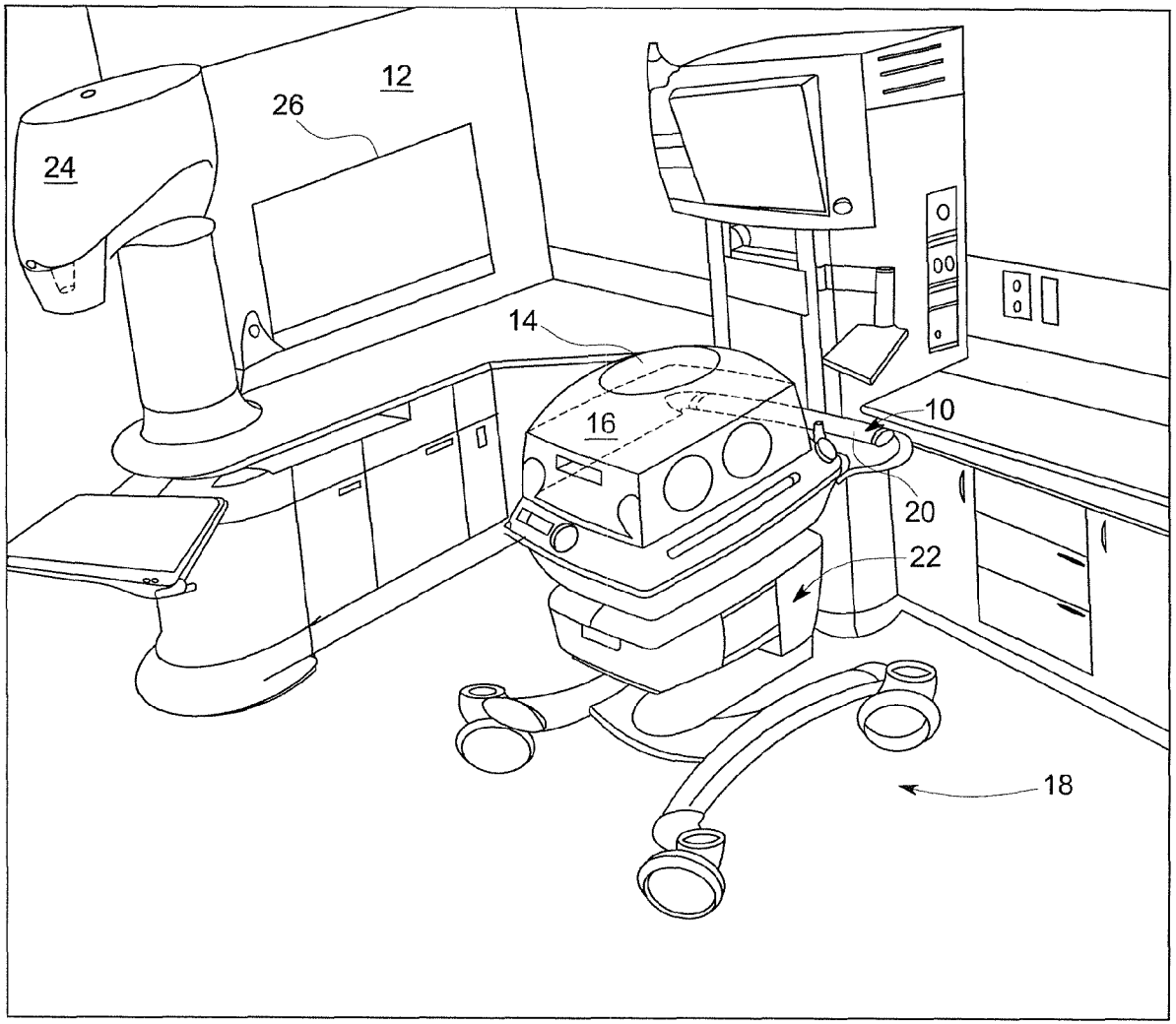
FIG. 1 is an environmental view of an infant care apparatus.

FIG. 1 is an environmental view of an embodiment of an infant care apparatus 10. The infant care apparatus 10 is located within a patient's room 12, which may be a part of a neonatal intensive care unit (NICU).

An infant care apparatus 10 is depicted in FIG. 1. The infant care apparatus 10 is an incubator-type infant care apparatus and includes an enclosure 14 which defines a microenvironment region 16. The infant care apparatus 10 is mobile as can be inferred from the wheels or casters 18 and a handle 20.

The incubator 10, like other convection-based heaters includes a heating system 22 beneath the enclosure 14.

The patient's room 12 includes an x-ray machine 24 and a x-ray viewing station 26. Various catheterization procedures performed on the patient require confirmation of the proper placement of the catheter before the procedure is finished. X-ray is often used for these confirmations, particularly in adults. When it comes to acquiring an x-ray of an infant, and particularly a premature infant, an x-ray of the entire patient may be successfully obtained in a standard 8×11 x-ray frame.

Despite the fact that the infant care apparatus 10 is mobile, it is often desirable to move the premature patient as little as possible as this can have a deleterious effect on the health of the premature infant. Therefore, it would be desirable to eliminate even unnecessary movements of the infant care apparatus 10 across the room to x-ray machine 24. This can be accomplished if the catheter confirmation can be performed on the patient without moving the patient.

Therefore, in the NICU, most imaging equipment or therapeutic instrumentation are mobile units or placed on carts and brought to the infant care apparatus in order to monitor or treat the patient.

Therapeutic instrumentation includes devices that provide treatment to the patient as opposed to imaging or other diagnostic devices. Therapeutic instrumentation therefore often involves providing a substance (e.g. intravenously) to the patient or removing a substance from the patient. Often this requires the placement and operation of a catheter.

Non-limiting examples of catheters that may be placed within the patient are: a peripherally inserted central catheter (PICC), a umbilical venus catheter (UVC), a umbilical arterial catheter (UAC), a peripheral intravenous catheter (PIV), a peripheral arterial catheter (PAC). These exemplary catheters provide access to the patient's vasculature for diagnosis or therapy, including the delivery of drugs and nutrition. Additionally, larger catheters may be inserted into the patient for providing therapy to other organ systems. These catheters exemplarily include a Foley catheter inserted into the bladder, a chest tube that is inserted into the lungs, an endotracheal (Et) tube, a nasal gastric (NG) tube that is inserted into the stomach.

Figure 2:
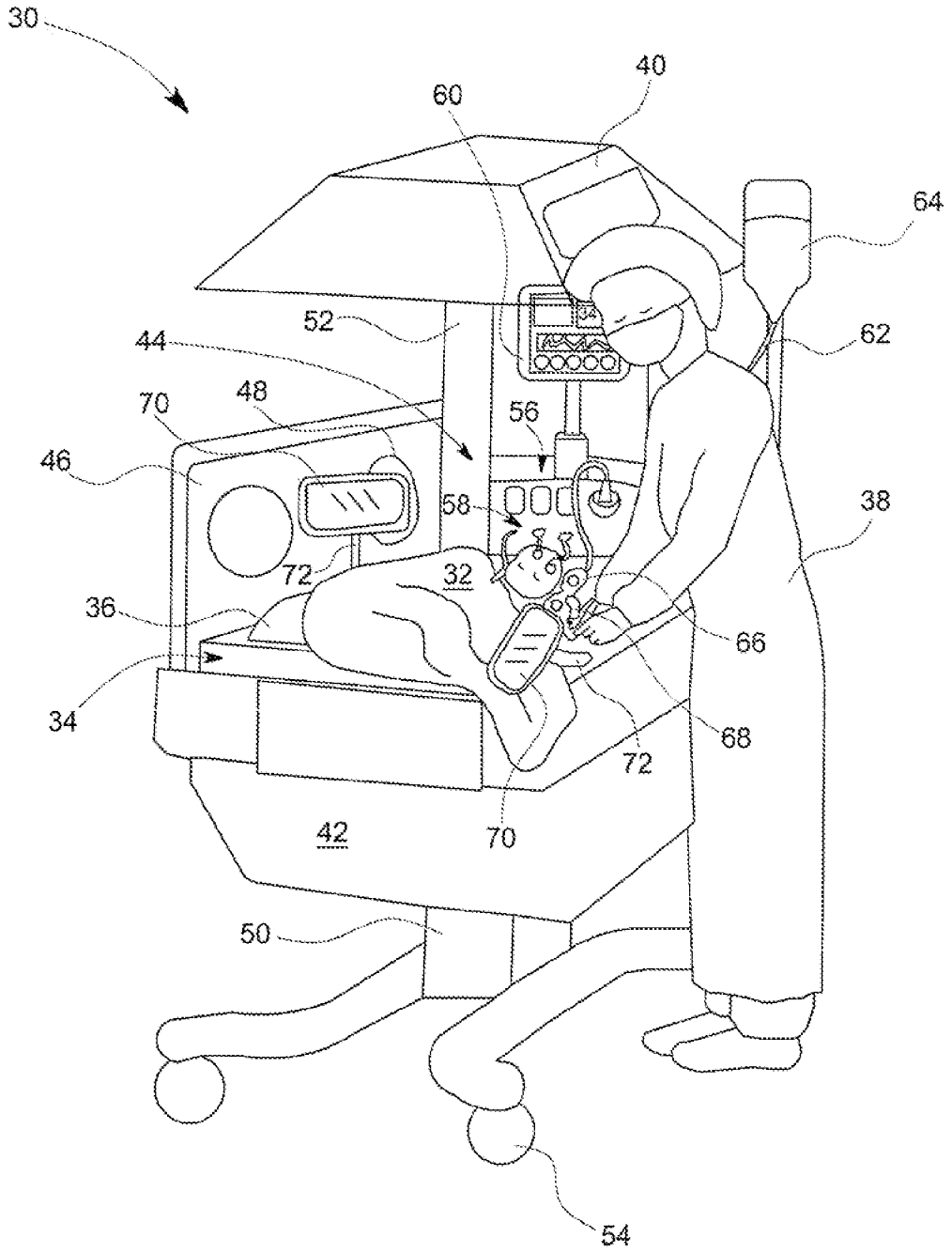
FIG. 2 is a system diagram of an embodiment of electrical components of an infant care system.

FIG. 2 depicts a more detailed embodiment of an infant care apparatus 30 as disclosed herein. The infant care apparatus 30 supports a patient 32 on a horizontal surface 34. It is understood that the horizontal surface 34 may be adjustable to some degree of tilt, but the horizontal surface 34 remains substantially horizontal when supporting a patient 32. In addition, the horizontal surface 34 may include a mattress 36 that is designed to support and cushion the patient 32. A clinician 38 is depicted in FIG. 2 as providing a therapeutic procedure to the patient 32. The actions of the clinician 38 will be described in greater detail herein.

The infant care apparatus 30 depicted in FIG. 2 includes a hybrid heating system. Therefore, the infant care apparatus 30 includes a radiant heater canopy 40. As described above, the canopy 40 contains heating elements, such as calrod heating elements that direct radiant heat down on the patient 32, mattress 36, and horizontal surface 34. Additionally, however, the infant care apparatus 30 includes a convective heating system 42 that is operable to provide convective thermal control to the patient 32. The convective heating system 42 forces a flow of air through a heating element to heat a microenvironment around the patient 32.

In embodiments of the infant care apparatus 30 that include a radiant heater canopy 40, the infant care apparatus includes a vertical frame 52 that supports the radiant heater canopy 40 in a position above the horizontal surface 34 and the patient 32. In hybrid embodiments of the infant care apparatus that include both the radiant heater canopy 40 and the convective heating system 42, the canopy 40 is vertically movable along the vertical frame 52. In a lowered position, the canopy 40 is lowered to promote efficiency of the convective heating system 42, as will be described in further detail herein. When the hybrid system is operated in a radiant heating manner, the radiant heater canopy 40 is raised along the vertical support 52, such that the clinician 38 has improved access to the patient 32. Internal controls of the infant care apparatus 30 may control which heating system provides the thermal regulation to the patient 32. Therefore, in one embodiment, only a single heating system is operable at one time to warm the patient 32.

In the infant care apparatus 30, the microenvironment region 44 is an area around the patient 32 within which the apparatus 30 controls the environmental conditions. In general, the microenvironment region 44 is defined as the space between the horizontal surface 34 and the canopy 40. Additionally, one or more walls 46 further define the microenvironment region 44. The walls 46 are selectively movable such as to allow access by the clinician 38 to the patient 32. In other embodiments, the walls 46 include one or more arm ports 48 through which a clinician 38 can reach so as to facilitate maintaining the microenvironment region 44 while the clinician 38 cares for the patient 32.

The infant care apparatus 30 is supported by a base 50 that provides vertical adjustment to the height of the infant care apparatus, and in particular, the height of the horizontal surface 34. The adjustable base 50 is mounted to casters 54 that enable the infant care apparatus 30 to be movable. In an embodiment, the casters 54 provide mobility to the infant care apparatus 30 for purposes of easily transporting the infant care apparatus 30 to a desirable location. In the same embodiment, once the patient 32 is in the infant care apparatus 30, the casters 54 may be locked and movement of the infant care apparatus 30 is limited to only those emergency situations while under normal conditions, infant care apparatus 30 provides many of the diagnostic and therapeutic functionalities required to care for the patient 32.

The infant care apparatus 30 further includes a variety of devices and features for monitoring and providing care to the patient 32. The infant care apparatus 30 includes a physiological monitor 56. In embodiments, the physiological monitor 56 is completely disposed within the microenvironment region 44. In other embodiments, a portion of the physiological monitor, such as physiological transducers 58 are disposed within the microenvironment 44, or otherwise extend into the microenvironment 44, and are attached to the patient 32 to acquire physiological signals from the patient 32. Non-limiting examples of the physiological monitors that may be used in the infant care apparatus include electrocardiograph (ECG), electroencephalograph (EEG), SPO2, temperature, non-invasive blood pressure (NIBP); however, it is understood that these are merely exemplarily and many other types of patient monitoring devices may be used in the presently disclosed manner. The physiological monitor 56 is connected to a graphical display 60. The graphical display 60 is similarly located fully or partially within the microenvironment region 44. In an alternative embodiment, the graphical display 60 is located outside of the microenvironment region 44. The graphical display 60 is operated to visually present the acquired physiological information to the clinician 38.

As noted above, the presently disclosed infant care apparatus is particularly designed to facilitate the interaction of a clinician 38 with a patient 32 such as for the purpose of providing care to the patient 32. In FIG. 2, the clinician 38 is performing a procedure, such as placing a peripheral IV. In the procedure, the clinician 38 connects a catheter 62 to a peripheral artery or vein of the patient 32 such that nutrition or medication found in an IV bag 64 can be delivered to the patient 32. Procedures such as this can be generally referred to as vascular access procedures, which all typically involve some type of catheterization of the patient's vasculature. A difficulty of catheterization therapies on an infant is that the proper placement of such a catheter must be visually confirmed to ensure proper placement. Therefore, the infant care apparatus 30 is equipped with a diagnostic imaging device 66. In the embodiment depicted in FIG. 2, the diagnostic imaging device 66 is an ultrasound diagnostic imaging system. However, it is understood that other forms of imaging may be used, including infrared spectroscopy, digital x-ray, or other forms of non-invasive imaging as would be recognized by one of ordinary skill.

The diagnostic imaging device 66 is located within the microenvironment region 44 such that an external imaging device does not need to be brought into the microenvironment region 44 of the patient moved to an imaging device when imaging confirmation is required.

In one embodiment, a support 68 that is configured to support the ultrasonic imaging wand extends from the horizontal surface 34. In such an embodiment, this support 68 provides a "third hand" to the clinician 38 to hold the ultrasound wand in the proper position, in this case, about the patient's brachial artery. The use of the support 68 frees the clinician's hands to provide more detailed attention to the catherization procedure being performed.

The infant care apparatus 30 includes at least one graphical display 70 that is disposed within the microenvironment region 44. The graphical display 70 is operated to visually present the images acquired by the diagnostic imaging device 66. In the embodiment depicted in FIG. 2, two graphical displays 70 are included within the microenvironment region 44. This enables the clinician to view the diagnostic images on the graphical display 70 that is most suited to the clinician's viewing during the procedure.

Additionally, the graphical display 70 may include a touch screen and a graphical user interface (GUI) presented on the graphical display 70 operates as the user input for the operation of the diagnostic imaging device 66. In this manner, both the output and the controls for the diagnostic imaging device 66 may be arranged for convenient use by the clinician 38 while performing the procedure. In a still further embodiment, the graphical displays 70 extend from the horizontal surface 34 upon a flexible support 72. This flexible support 72 may be an articulated support, such as a goose neck, that allows the clinician 38 to adjust the position and orientation of the graphical display with respect to both the clinician 38 and the patient 32.

In a still further embodiment, the graphical displays 70 are covered with a disposable plastic sheathing (not depicted). This plastic sheathing protects the graphical display 70 from contamination. This plastic sheathing can be periodically replaced in an ongoing effort to maintain a sterile environment around the patient 32.

Figure 3:
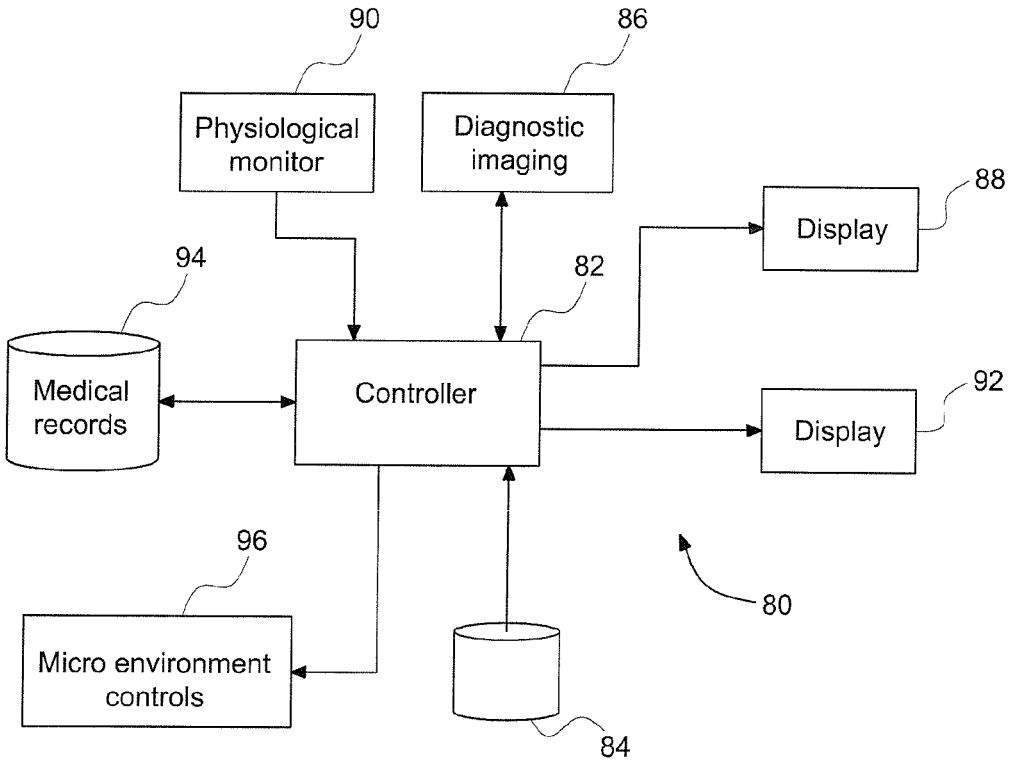
FIG. 3 depicts an embodiment of an infant care apparatus.

FIG. 3 is a schematic diagram of an infant care apparatus 80 that focuses on the electrical and communicative connections between components. The infant care apparatus 80 includes a controller 82. The controller 82 may be any of a variety of known controllers, microcontrollers, or microprocessors. The controller 82 is communicatively connected to a computer readable medium 84 upon which computer readable code is stored. The computer readable medium 84 may be any of a known variety of computer memory, including, but not limited to, non-volatile memory such as EEPROM, flash memory, optical memory, or removable data storage. The computer readable medium 84 stores computer readable code that includes instructions that when executed by the controller 82 causes the controller to perform functions and operations as disclosed herein.

The controller 82 is connected to a diagnostic imaging device 86. As disclosed above, the diagnostic imaging device 86 is, in one embodiment, an ultrasound imaging device; however, in alternative embodiments, other diagnostic imaging platforms such as digital x-ray or infrared spectroscopy may be used. The controller 82 provides instructions and controls to the diagnostic imaging device 86 and receives diagnostic images acquired by the device 86.

The computer readable medium 84 includes computer readable code that allows the controller to process the received diagnostic images and operate a graphical display 88 in a suitable manner such as to present the acquired diagnostic images. The presentation of the acquired diagnostic images on the graphical display 88 can include further processing of the images such as to facilitate the review of these images by the clinician.

The controller 82 is connected to a physiological monitor 90. The physiological monitor 90 acquires various physiological signals and the biopotentials from the patient and provides the acquired physiological signals to the controller 82 for processing. The controller 82 processes the received physiological information from the physiological monitor 90 and operates a graphical display 92 in a manner such as to visually present the acquired physiological information.

The controller 82 is further communicatively connected to a database of medical records 94. This database of medical records may be locally stored, such as in a storage device integral with, or removably connected to, the infant care apparatus 80. Alternatively, the database of medical records is a part of a hospital information system (not depicted). The medical records stored on the hospital information system are available through communication by the controller 82 over a hospital local intranet or the Internet. The communicative connection between the controller 82 and the medical records database 94 may be any of a variety of wired or wireless communication platforms.

The controller 82 is further connected to a variety of microenvironment controls 96. These microenvironment controls 96 include the mechanical and electronic components and controls of other systems of the care apparatus 80. The microenvironment controls 96 include those systems known in the field for maintaining desirable levels of temperature, humidity, and oxygen within the microenvironment. Additionally, the controller 82 controls the radiant heater and the convective heater described above, which may be operated in a manner such as to also maintain the established temperature, humidity, and oxygen levels. The controller 82 may further control raising and lowering the canopy in connection with the control of the radiant heater and the convective heater.

Figure 4:
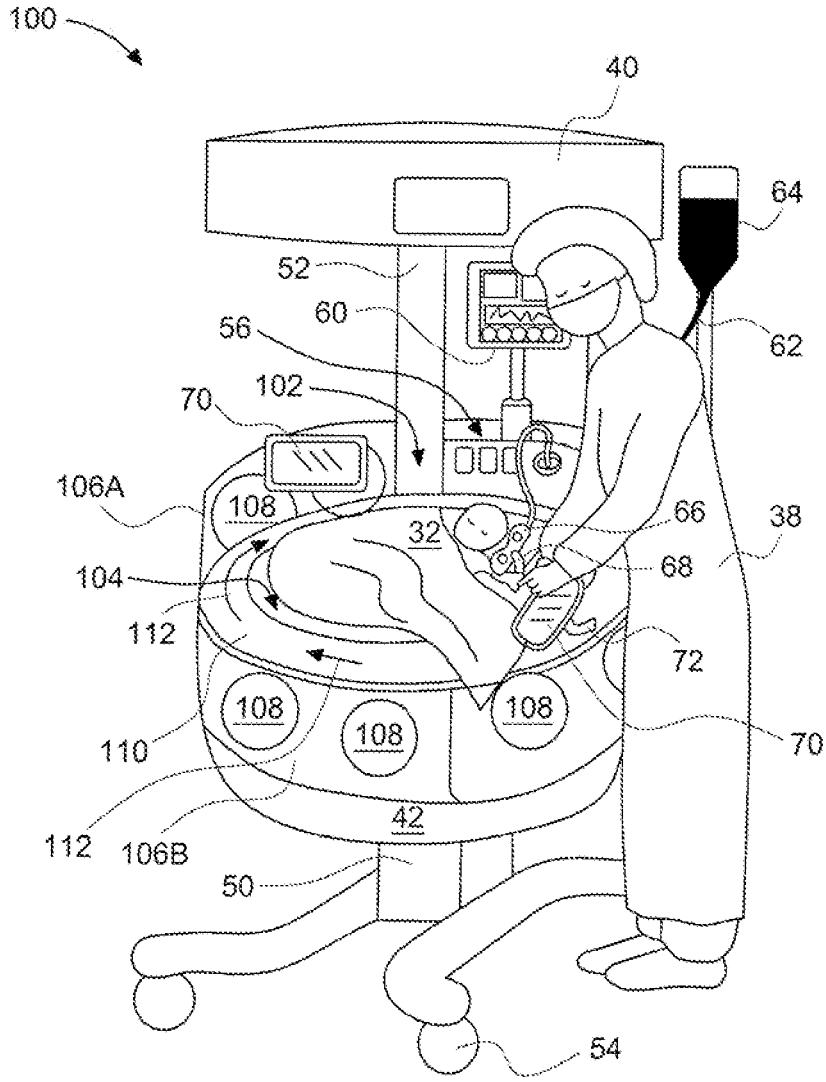
FIG. 4 depicts an alternative embodiment of an infant care apparatus.

FIG. 4 depicts an alternative embodiment of an infant care apparatus 100. It should be noted that like reference numerals between FIGS. 4 and 2 are used to denote like structures. Similar structures between the embodiments of FIG. 4 and FIG. 2 will not be described in further detail herein such as to focus on the disclosed features of the embodiment of the infant care apparatus 100 in FIG. 4.

The infant care apparatus 100 defines a microenvironment region 102 about an infant patient 32. The microenvironment region 102 is defined between a horizontal surface 104 and at least one wall 106A, 106B extending substantially perpendicular to the horizontal surface 104. In the embodiment of the infant care apparatus 100 depicted in FIG. 4, the walls 106 are constructed of a flexible plastic material, such that one or more wall sections are movable to facilitate access by the clinician 38 to the patient 32. In FIG. 4, wall 106B has been moved into a downward position to improve access by the clinician 38 to the patient 32. When a wall is in the up position, such as wall 106A, the clinician 38 still has access to the patient 32 through arm ports 108. When the wall is in a down position, as exemplified by previously mentioned wall 106B, the clinician 38 is provided with more unfettered access to the patient 32. By selectively folding down portions of the wall 106, the clinician 38 is afforded access to the patient 32, while contributing to maintaining the microenvironment region 102 with any remaining upstanding walls 106A. A rotatable carousel 110 surrounds the horizontal surface 104 that supports the patient 32. One or more graphical displays 70 are attached to the carousel 110. The carousel 110 allows the clinician 38 to move the graphical display 70 about the patient 32 in order to place the graphical display 70 at an optimal location for viewing by the clinician 38 while the clinician 38 performs a medical procedure on the patient 32. The carousel 110 allows the clinician to move the graphical display 70 without disturbing the patient 32 who is supported on the horizontal surface 104. In an embodiment, the graphical display 70 is connected to the carousel 110 by a flexible support 72. This facilitates further positional adjustment of the graphical display 70 by the clinician.

In an alternative embodiment, one or more of the physiological monitor 56 and the diagnostic imaging device 66 are also mounted to the rotating carousel 110. Mounting these components to the carousel 110 allows the clinician 38 to further control the position and the angle of connections between the patient monitoring device 36 or the diagnostic imaging device 66 with the patient 32 into a least obtrusive manner to the patient, or most convenient arrangement for the clinician 38 performing the procedure. The mounting of additional components such as the physiological monitor 56 and the diagnostic imaging device 66 further reduces the need to move the patient 32 when performing a medical procedure using these pieces of equipment.

As has been disclosed above, embodiments of the infant care apparatus disclosed herein may be used by a clinician in providing treatment or therapy to the patient while also monitoring the patient with diagnostic imaging or physiological monitoring capabilities. The embodiments of the infant care apparatus disclosed herein can extend through a variety of procedures of varying complexity. Vascular access procedures, as disclosed above, include the insertion of PICC, UVC, UAC, PIV, or PAC catheters. The proper guidance and placement of these catheters requires confirmation of catheter placement using a diagnostic imaging device provided as part of the infant care apparatus. The clinician may further conduct tube replacement procedures which typically treat organs or organ systems through the insertion of a large catheter. There include the placement of an ET tube, an NG tube, a Foley catheter, or a chest tube. Finally, the diagnostic imaging devices provided as part of the infant care apparatus as disclosed herein provide the functionality to a clinician in order to perform further organ diagnostic exams and tests, through the use of advanced diagnostic imaging techniques. The controller of the infant care apparatus can be programmed with software required to perform these diagnostic analyses on organ systems such as the patient's brain, kidneys, or gut through the use of the diagnostic imaging device provided with the infant care apparatus.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An infant care apparatus, the apparatus comprising:

a horizontal surface configured to support an infant;

at least one wall extending generally vertically from the horizontal surface;

a canopy movably positioned above the horizontal surface, the canopy movable between a closed position wherein the canopy engages the at least one wall and an open position wherein the canopy is vertically spaced apart from the horizontal surface and the at least one wall:

a microenvironment region defined as a volume bounded by the horizontal surface, the at least one wall, and the canopy;

a graphical display disposed within the microenvironment region;

a diagnostic imaging device at least partially disposed within the microenvironment region, the diagnostic imaging device configured to obtain diagnostic images of the infant in the microenvironment region; and a processor coupled to the graphical display and the diagnostic imaging device, wherein the processor operates the diagnostic imaging device to acquire diagnostic images and the processor operates the graphical display to present the diagnostic images on the graphical display.

2. The infant care apparatus of claim 1, wherein the canopy further comprises a radiant heater generally parallel and opposed to the horizontal surface, wherein the radiant heater heats the microenvironment region to a predetermined temperature.

3. The infant, care apparatus of claim 1, further comprising:

a convective heater that heats the microenvironment region to a predetermined temperature, and the microenvironment region is further defined by an enclosure provided by the canopy in the closed position, the horizontal surface, and the at least one wall;

an oxygen source coupled to the microenvironment region, such as to supply oxygen to the microenvironment region; and a humidifier coupled to the microenvironment region, the humidifier controlling a level of humidity within the microenvironment region.

4. The infant care apparatus of claim 1, wherein the graphical display is movably disposed within the mincroenvironment region and the graphical display is configured to be moved relative to a position of an infant within the microenvironment and a clinician about the microenviroment.

5. The infant care apparatus of claim 4, further comprising:

therapeutic instrumentation at least partially disposed within the microenvironment region the therapeutic instrumentation being, configured to perform vascular access procedures.

6. The infant care apparatus of claim 5, wherein the therapeutic instrumentation is further configured to perform intubation procedures.

7. The infant care apparatus of claim 1, further comprising at least one physiological transducer at least partially disposed within the microenvironment region, the at least one physiological transducer configured to obtain physiological data from the infant.

8. The infant care apparatus of claim 7, wherein the processor is further communicatively connected to the at least one physiological transducer, and the processor operates the graphical display to present the physiological data on the graphical display.

9. The infant care apparatus of claim 1. wherein the diagnostic imaging device is an ultrasonic imaging device.

10. The infant care apparatus of claim 9, wherein the diagnostic imaging device extends into the microenvironment region through the horizontal surface.

11. An infant care apparatus, the apparatus comprising:

an infant platform comprising a surface configured to support an infant;

a plurality of walls extending generally upwards from the infant platform;

a canopy movably positioned above the infant platform, the canopy movable between a closed position wherein the canopy engages the plurality of walls and an open position wherein the canopy is vertically spaced apart from the infant platform and the plurality of walls;

a microenvironment region defined as a three-dimensional volume bounded by the infant platform, the canopy, and the plurality of walls;

a heat source configured to warm the microenvironment region to a predetermined temperature;

a first graphical display disposed within the microenvironment region;

a diagnostic imaging device at least partially disposed within the microenvironment region, the diagnostic imaging device extending into the microenvironment region through a first port in the surface of the infant platform;

a processor coupled to the first graphical display and the diagnostic imaging device, wherein the processor operates the diagnostic imaging device to acquire diagnostic images and the processor operates the first graphical display to present the diagnostic images on the first graphical display.

12. The infant care apparatus of claim 11, further comprising:

a convective heater disposed within the infant platform, the convective heater operating to warm air to a predetermined temperature and circulate the air through the microenvironment region;

a humidifier disposed within the infant platform and pneumatically connected to the microenvironment region to maintain a predetermined level of humidity within the microenvironment region; and an oxygen source disposed within the infant platform and pneumatically connected to the microenvironment, region to maintain a predetermined oxygen concentration within the microenvironment region.

13. The infant care apparatus of claim 12, further comprising:

at least one physiological transducer at least partially disposed within the microenvironment region, the at least one physiological transducer extending into the microenvironment region through a second port in the surface of the infant platform;

wherein the at least one physiological transducer is communicatively connected to the processor, such that the processor is configured to acquire physiological data from the infant in the microenvironment region.

14. The infant care apparatus of claim 13, further comprising:

a vertical frame outside of the microenvironment region and extending upwards relative to the infant platform, and the canopy is movably secured to the vertical frame to move between the open and closed positions; and a second graphical display associated with the vertical frame at a location outside of the microenvironment region, the second graphical display communicatively connected to the processor, the processor operating the second graphical display to present the physiological data;

wherein the first graphical display is movable within the microenvironment region.

15. The infant care apparatus of claim 14 wherein the processor operates the first graphical display to turn on and present diagnostic images when the diagnostic imaging device is in use and the processor further operates the second graphical display to present physiological data from the at least one physiological transducer when the diagnostic imaging device is in use.

16. The infant care apparatus of claim 15, further comprising:

at least one therapeutic instrument partially disposed within the microenvironment region, the at least one therapeutic instrument extending into the microenvironment region through a third port in the surface of the infant platform;

wherein the at least one therapeutic instrument comprises a vascular access instrument.

17. An infant care system, the system comprising:

an infant platform comprising a surface configured to support an infant;

a plurality of walls extending generally upwards from the surface;

a microenvironment region defined as a three-dimensional volume bounded by the surface and the plurality of walls;

a diagnostic imaging device at least partially disposed within the microenvironment region, the diagnostic imaging device configured to obtain diagnostic images of the infant in the microenvironment region;

at least one physiological transducer at least partially disposed within the microenvironment region, the physiological transducer configured to obtain physiological data from the infant in the microenvironment region;

a first graphical display disposed within the microenvironment region to present the diagnostic images of the infant;

a second graphical display disposed outside of the microenvironment region to present physiological data; and a processor communicatively connected to the diagnostic imaging device, the at least one physiological transducer, the first graphical display, and the second graphical display, wherein the processor is operable to control the diagnostic imaging device to acquire diagnostic images and to control the first graphical display to present the acquired diagnostic images and wherein the processor is further operable to acquire physiological data through the at least one physiological transducer and to control the second graphical display to present the physiological data.

18. The infant care system of claim 17, wherein the processor is contained within the infant platform.

19. The infant care system of claim 18, wherein the diagnostic imaging device and the at least one physiological transducer extend into the microenvironment region through at least one port in the surface of the infant platform.

20. The infant care system of claim 19, further comprising a rotating carousel about the infant platform within the microenvironment region;

wherein at least the first graphical display is mounted on the rotating carousel such that the first graphical display is rotatably positionable about the infant platform without moving the infant platform.

* * * * *